US006135924A

United States Patent [19]

Gibbs et al.

[11] Patent Number: 6,135,924

[45] Date of Patent: Oct. 24, 2000

[54] TREADMILL WITH OPTICAL POSITION SENSING

[75] Inventors: Duane Carol Gibbs, Alta Loma; Craig I. Garza, Huntington Beach; Rick T. K. Choy, Santa Ana; Edwin J. Yagerlener, Costa Mesa, all of Calif.

[73] Assignee: Unisen, Inc., Irvine, Calif.

[21] Appl. No.: 09/056,403

[22] Filed: Apr. 7, 1998

Related U.S. Application Data

[60] Provisional application No. 60/041,892, Apr. 11, 1997.

[51] Int. Cl.[7] ..... A63B 22/00

[52] U.S. Cl. ..... 482/54; 482/51

[58] Field of Search ..... 482/51, 54

[56] References Cited

U.S. PATENT DOCUMENTS

| | | | |
|---|---|---|---|
| 4,312,033 | 1/1982 | Sweeney et al. . | |
| 4,353,019 | 10/1982 | Sweeney et al. . | |
| 4,708,337 | 11/1987 | Shyu | 482/54 |
| 4,749,181 | 6/1988 | Pittaway et al. . | |
| 5,230,418 | 7/1993 | Agnoff | 482/54 |
| 5,314,391 | 5/1994 | Potash et al. | 482/54 |
| 5,690,587 | 11/1997 | Gruenangerl | 482/54 |
| 5,800,314 | 9/1998 | Sakakibara et al. | 482/54 |

OTHER PUBLICATIONS

Specification Sheet by LITEON, entitled Infrared Remote Control Receiver Modules LTM–8834 Series Side Viewing.

*Primary Examiner*—Glenn E. Richman

*Attorney, Agent, or Firm*—Knobbe, Martens, Olson & Bear LLP

[57] ABSTRACT

An exercise treadmill machine is provided in which an optical sensor monitors the position of a user on the treadmill and automatically varies the speed of the treadmill to keep the user near a predetermined position on the treadmill's endless belt. The optical sensor preferably includes an infrared (IR) emitter and an IR detector which are located in or near the treadmill control panel that also houses a preprogrammed microprocessor. The microprocessor controls the speed of the belt as required to adjust for variations in the position of the user.

23 Claims, 7 Drawing Sheets

A: /INITIALIZE
B: INITIALIZE
C: /ACQUIRE*/OUT-OF-RANGE
D: ACQUIRE*/OUT-OF-RANGE
E: START
F: OUT-OF-RANGE
G: /SLOW*/FAST*/OUT-OF-RANGE
H: FAST*/OUT-OF-RANGE
J: FAST*/OUT-OF-RANGE
K: OUT-OF-RANGE
L: OUT-OF-RANGE
M: /SLOW*/OUT-OF-RANGE
N: SLOW*/OUT-OF-RANGE
O: SLOW*/OUT-OF-RANGE
P: /FAST*/OUT-OF-RANGE
Q: OUT-OF-RANGE
R: /START

TREADMILL WITH OPTICAL POSITION SENSING

RELATED APPLICATIONS

This application claims priority to U.S. provisional application Ser. No. 60/041,892, filed on Apr. 11, 1997.

BACKGROUND OF THE INVENTION

1. Field of the Invention

This invention relates to a treadmill exercise machine, and more specifically, to a treadmill exercise machine which automatically compensates for a change in the user's pace by using optical sensing to establish the user's position and increasing or decreasing the speed of the treadmill, accordingly.

2. Background of the Related Art

Treadmill exercise machines are known in which a user walks or jogs upon an endless belt or treadmill in order to exercise his muscles and/or to provide an aerobic workout. Typical treadmill exercise machines fall into two categories, powered and unpowered. Typical unpowered treadmill machines may have an endless belt or treadmill disposed within a floor mounted chassis. A handle or railing may extend up from the chassis for the user to hold onto and push against while exercising. The force of the users legs on the treadmill cause it to move in an endless loop along rollers, pulleys or the like. An adjustable damping device is typically provided to provide resistance to the forward running or walking motion exerted by the user.

Typical powered treadmill exercises machines are constructed much in the same way as described above, except that they include a motor for powering the endless belt treadmill at one or more desired speeds. A handle or other grip may be provided for balance, but is not required for operation of the machine. The speed of the treadmill is determined by the rotational speed of the motor which drives the treadmill. The motor speed may be preset or it may be adjustable, depending upon the intensity of the workout desired.

In some cases it is desirable for a user to run at alternating speeds, such as for interval training, wherein the user alternates exercise intensity between two or more levels. Alternatively, a user may vary his speed during a workout due to simple fatigue over time. In those cases, however, a drawback of conventional powered treadmill exercise machines is that they run at a constant speed regardless of the speed of the user.

SUMMARY OF THE INVENTION

The present invention is directed towards an exercise treadmill machine in which an optical sensor monitors the position of a user and automatically varies the speed of the treadmill to keep the user near a predetermined position on the treadmill's endless belt. The optical sensor preferably includes an infrared (IR) emitter and an IR detector which are located in or near the treadmill control panel that also houses a programmed, controlling microprocessor. The microprocessor controls the speed of the belt as required.

No change to the belt's speed is made as long as the user remains walking or running at a predetermined position 1 to 2 feet from the front of the treadmill. However, when the user walks or runs faster than the treadmill belt and moves closer to the front of the treadmill (where the optical sensor is located), the programmed microprocessor causes the belt of the treadmill to speed up. Conversely, if the user moves towards the rear of the treadmill, i.e., the user is moving more slowly than the belt, the programmed microprocessor causes the belt to slow down so that the user returns to the predetermined starting position on the belt. If the user moves more than 3 feet from the front of the treadmill, or steps off the treadmill, the invention operates as a safety off switch to stop the belt altogether.

The position of the user is determined by monitoring the beam reflected off the user and onto the detector. As the user moves toward the front of the treadmill, the relative fraction of the IR power landing on the detector increases, and vice versa.

One advantage of the invention is that the user's position is maintained in the running area through automatic adjustment of the belt's speed.

Another advantage of the invention is that the belt is automatically stopped if the user is not detected in the running area.

Yet another advantage of the invention is that the microprocessor averages a number of pulses (typically 5) to account for the variation in light intensity that can arise from repetitive motion such as swinging of the arms.

Still another significant advantage of the invention is that the color of the user's clothing is automatically compensated for, and either dark or light colored clothing can be worn.

DETAILED DESCRIPTION OF THE INVENTION

Figure 1:
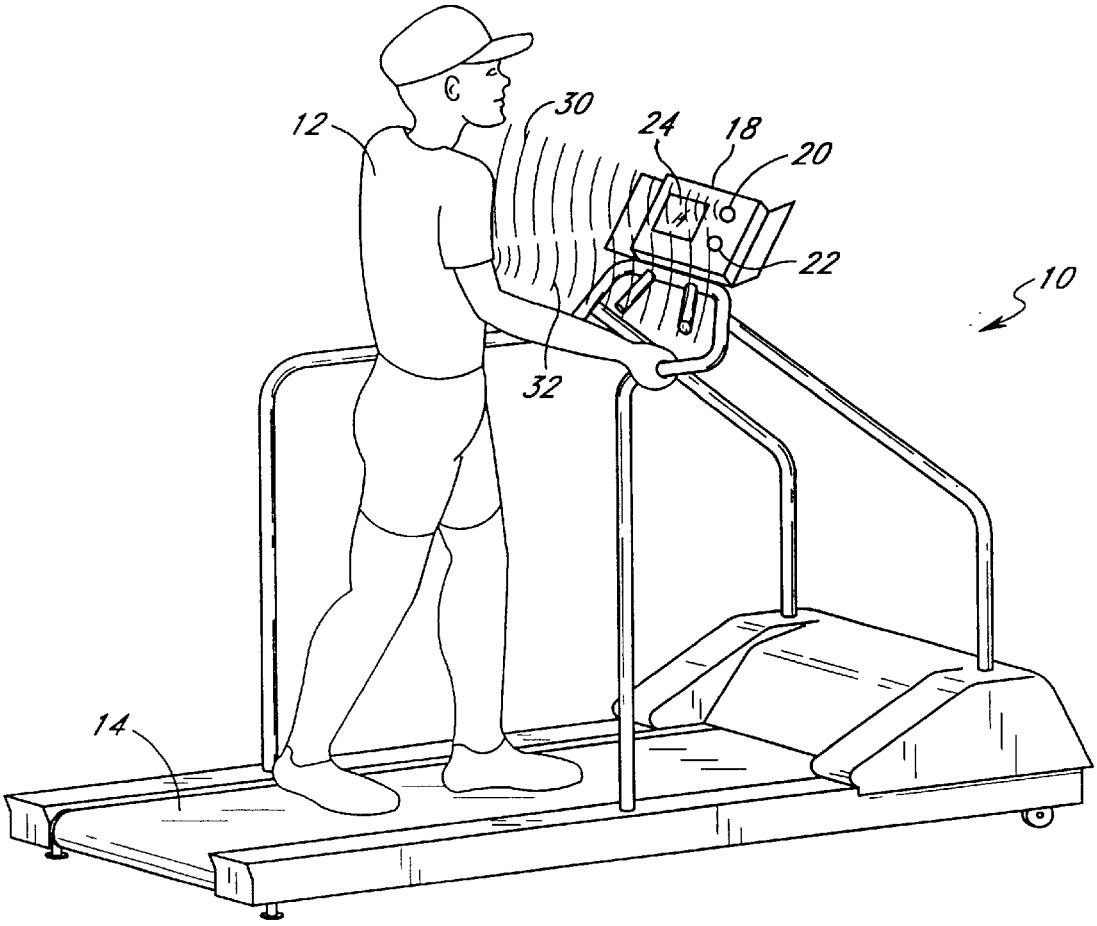
FIG. 1 is a perspective view of an exercise treadmill in which the user's position is determined by reflecting a fraction of a beam from an IR emitter onto an optical detector.

As shown in FIG. 1, a treadmill 10 senses the position of user 12 and automatically compensates for changes in the user's pace. The treadmill 10 includes an endless belt 14 and a control panel 18 located in front of the user 12. An optical emitter 20 and an optical detector 22 are advantageously mounted within the control panel 18 and operate in the infrared (IR) portion of the electromagnetic spectrum. (Liteon GaAlAs LTE-4228U Infrared Emitting Diodes and LTM-8834 Infrared Remote Control Receiver Modules work well for this purpose.) The emitter 20 and detector 22 are coupled to a programmed microprocessor 24 that is also mounted within the control panel 18. The programmed microprocessor 24 controls the speed of the belt 14 to keep the user 12 at a predetermined position in the running area.

The emitter 20 directs a beam 30 of electromagnetic radiation (photons) toward the torso of the user 12, preferably in a solid angle of approximately 20 degrees. Some of the emitted beam 30 is reflected off the user 12 as reflected beam 32, and part of this reflected beam is detected by the detector 22. The fraction reaching detector 22 depends on the brightness (reflectivity) of any clothing worn by the user 12 as well as the position of the user on the belt 14. Since the reflectivity of the user's clothing remains essentially constant over distance, however, variations in this fraction can be attributed to changes in the user's distance from the control panel 18, with the microprocessor 24 controlling the belt's speed as required to keep the user 12 within his or her normal exercise area on belt 14. Thus, the invention compensates for either dark or light-colored clothing.

As the user 12 moves further away from the emitter 20, the fraction of optical radiation reflected by the user onto the detector 22 decreases. Conversely, this fraction increases as the user 12 moves closer to the emitter 20. Accordingly, this provides a means for detecting whether the user is moving toward or away from the control panel 18. For example, if the fraction of optical radiation collected by detector 22 is decreasing with respect to the fraction corresponding to the user's starting position (i.e. if the relative fraction is decreasing), then the user's distance from the control panel 18 must be increasing with respect to his starting position.

Figure 2A:
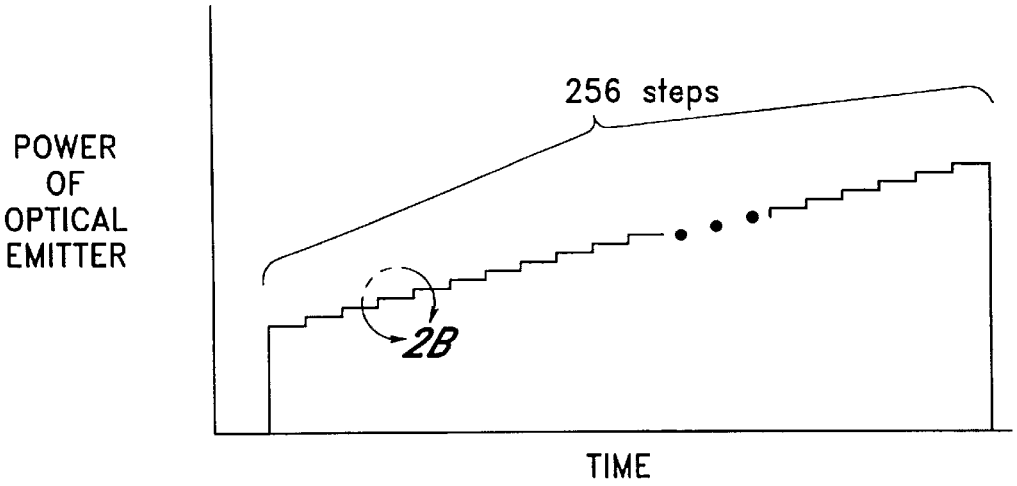
FIGS. 2A and 2B illustrate the amplitude and frequency modulation of the emitted beam, respectively.
Figure 2B:
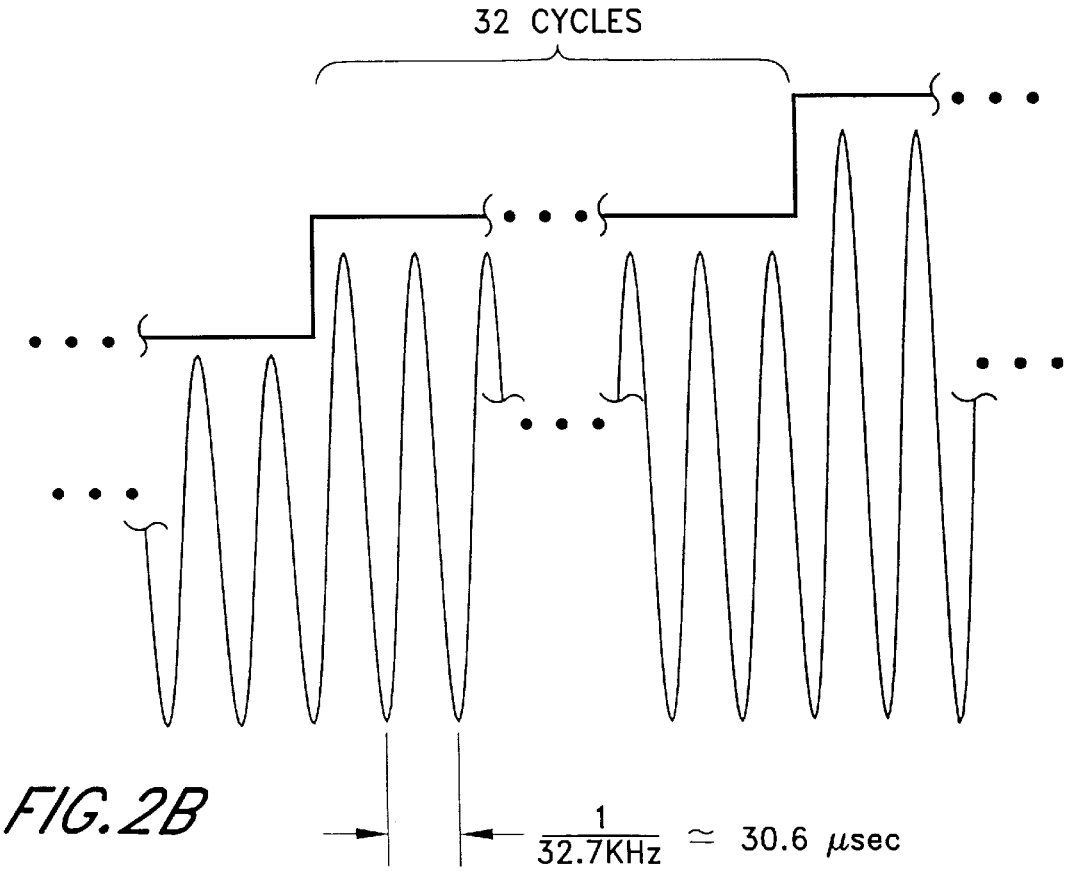

In the preferred embodiment, the power of the emitted beam 30 is varied during exercise until the signal level at the detector 22 corresponds to its level just before exercise. This is preferably done with a frequency modulated IR beam (at or near 32.7 kHz, although other frequencies may work as effectively as long as they are matched to the bandpass filter center frequency in the detector 22) that is also amplitude modulated, with the sensitivity range of the optical emitter 20 chosen to accommodate the optical extremes of white clothing only 6 inches from the detector 22 (the close range power level setting) and dark clothing located at the opposite end of the treadmill (the long range power level setting), which is taken to be 42 inches from the control panel 18. As illustrated in FIGS. 2A and 2B, the amplitude is preferably "stepped up" after every 32 cycles, with the maximum amplitude being reached after 256 such "steps" of original amplitude. When the signal level at detector 22 reaches its level before exercise, then further increases in the signal amplitude of emitted beam 30 are not required, and the programmed microprocessor 24 reads the power level of the emitted beam and then resets it to its minimum value.

Figure 3:
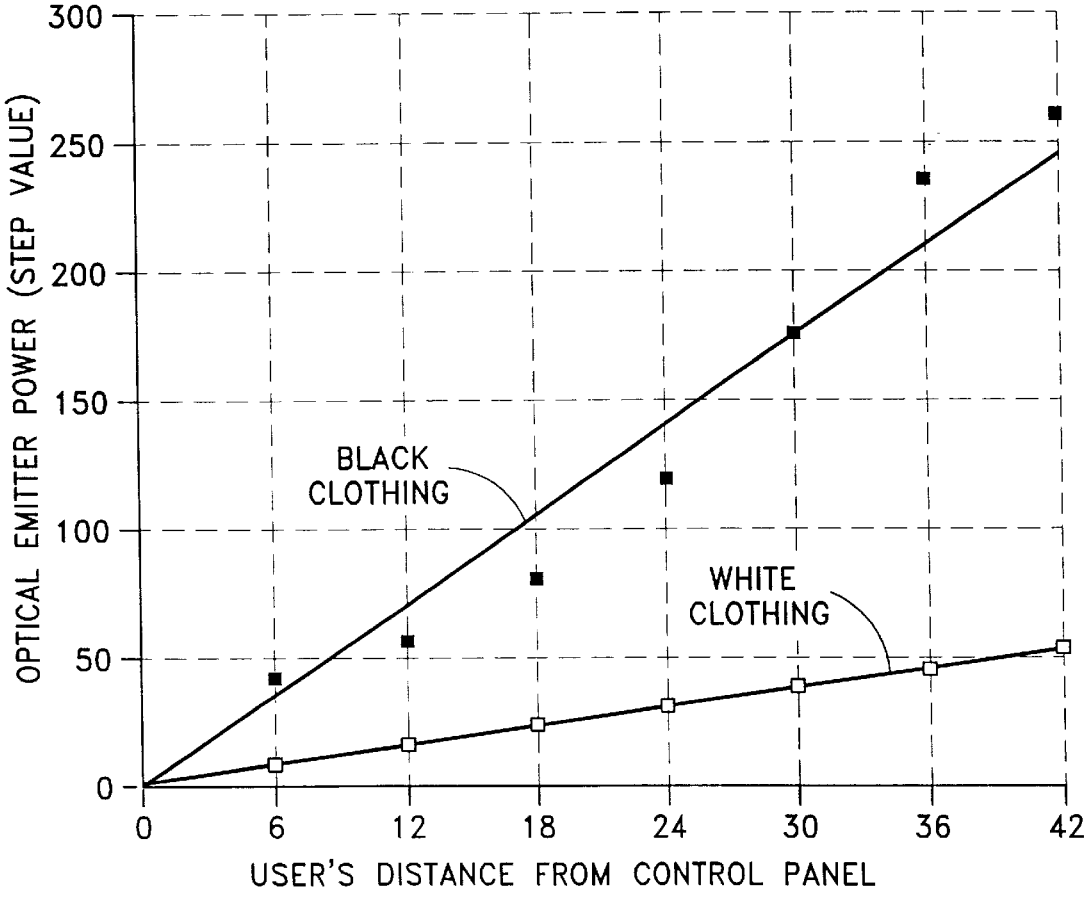
FIG. 3 presents data showing that the optical emitter power required to maintain a constant signal at the decoder varies substantially linearly with the user's distance from the front of the treadmill.

The precise functional relationship between the user's position and the power of emitted beam 30 required to maintain constant signal level at a detector 22 will depend upon the detector's internal electronics. Detector 22 preferably includes an IR sensitive material (diode), an amplifier, a limiter, a bandpass filter at about 32.7 kHz to match the frequency of the emitted beam 20, a detector demodulator (diode), an integrator, and a comparator (with hysteresis) at the detector's output which compares the signal level from the integrator with a triggering level preset at the factory. (The triggering level can be, for example, 2.5 V for 0–5 V output; the output of detector 22 thus acts as a "flag" which indicates whether the power of the emitted beam 30 is sufficiently high.) The empirical data shown in FIG. 3 indicate that for the detector 22 used to collect these data, both black and white clothing produce a nearly linear relationship between the required emitted beam power and distance on the belt 14 from the control panel 18. It can be inferred that for reflectivities between these extremes, a linear relationship also exists, in which the slope of the line is determined by the reflectivity of the user's clothing.

In the preferred embodiment, calibration is performed by having the user 12 start his or her exercise routine at a known distance from the control panel 18. The reflectivity of the user's clothing is then determined, allowing the user's subsequent distance from the control panel to be determined optically. In one specific embodiment of this invention, the microprocessor software calibrates the user 12 when the user is standing 18 inches from the control panel 18 while a reference reading is taken, although the software could be programmed to accommodate other initial positions instead. A feature of this invention is that the effects of the transitory positions of an arm or hand, or repetitive motion such as swinging of the arms, are substantially eliminated. While exercising, typically 10 signal levels are detected each second. Every five readings are averaged to provide a distance measure. This mitigates the effect of a spurious reading depending too strongly upon a transitory position of an arm or hand, and also averages out repetitive motion such as swinging of the arms. Using the linear algebraic relationships shown in FIG. 3, the programmed microprocessor 24 determines whether the user's position has changed, and if a correction to the speed of the belt 14 is required.

Figure 4:
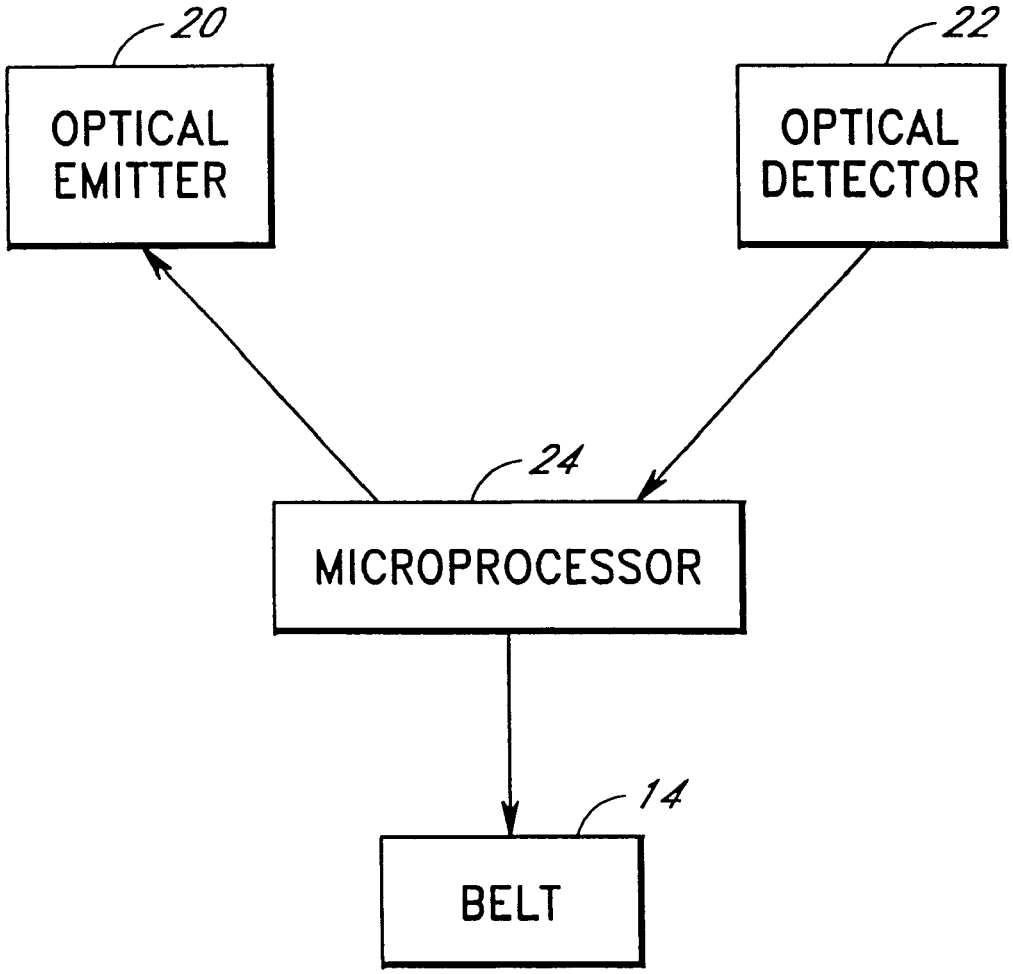
FIG. 4 is a block diagram showing a microprocessor controlling the belt speed in view of information from the optical emitter and detector.
Figure 5:
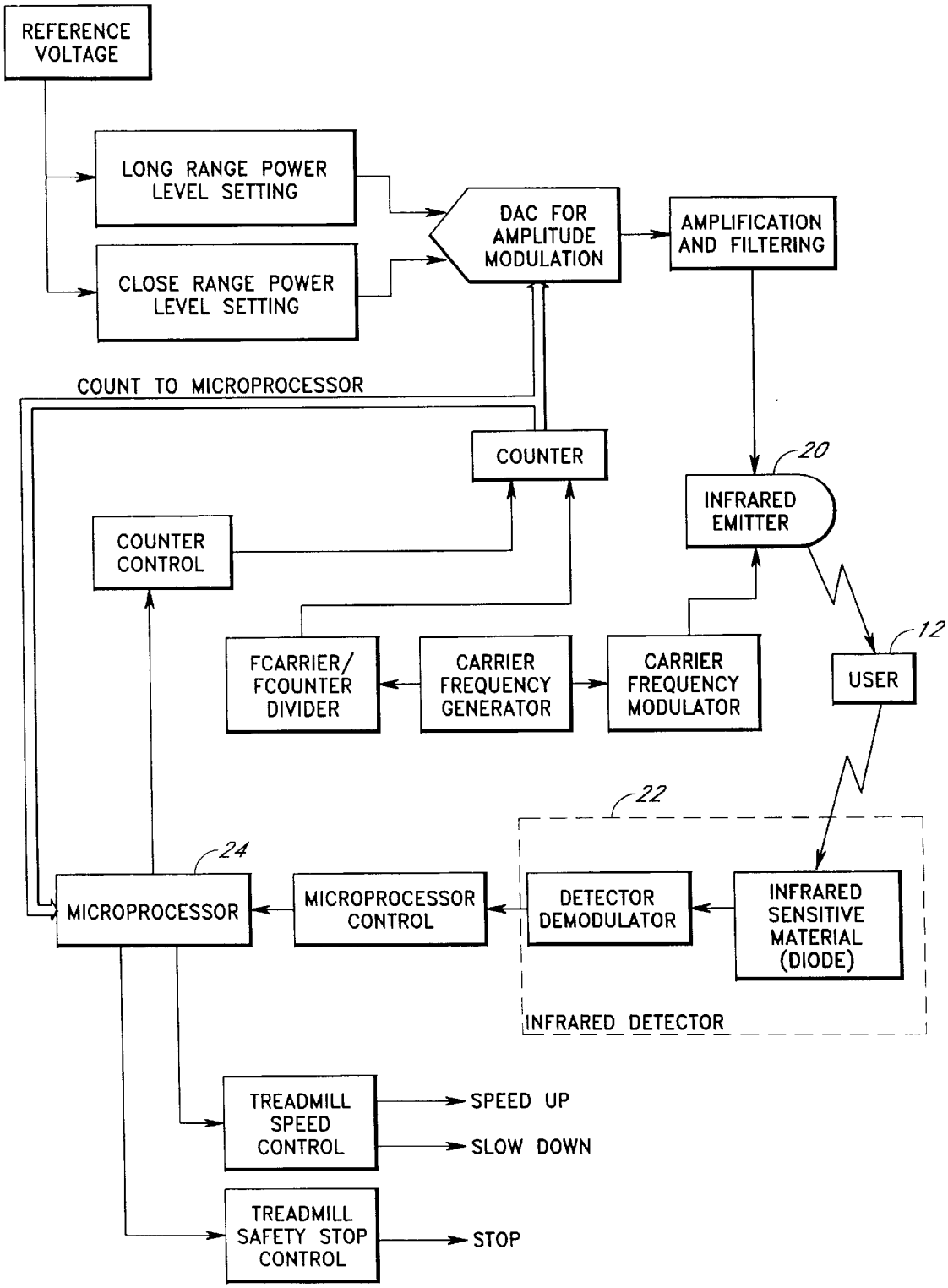
FIG. 5 is a block diagram that is more detailed than FIG. 4, showing the relationship between the microprocessor and the components with which it communicates.

The relationship between the emitter 20, detector 22, microprocessor 24, and belt 14 is shown in a block diagram in FIG. 4. The microprocessor 24 controls the intensity of the beam 30 (FIG. 1) as it propagates from the emitter 20. The programmed microprocessor 24 also receives signals from detector 22 corresponding to a portion of reflected beam 32. The microprocessor 24 controls the speed of the belt 14, increasing or decreasing it as required. A more detailed schematic of these interrelationships is shown in FIG. 5. The long range and close range power level settings mentioned in FIG. 5 refer to the optical emitter 20 and are set by the manufacturer before shipping (see also FIG. 2A, which shows these limits graphically).

The software is programmed within microprocessor 24 so that if the user 12 is determined to be between 12 and 24 inches from the control panel 18 (the "steady state zone"), the belt 14 maintains a constant speed. However, if the user 12 comes within 12 inches of the control panel 18 (the "speed up zone"), the programmed microprocessor 24 causes the belt 14 to increase its speed in increments of 0.1 mph, by two increments/sec during the first second and by five increments/sec thereafter, until the user is returned to the steady state zone. Conversely, if the user 12 is determined to be between 24 and 36 inches from the control panel 18 (the "slow down zone"), the programmed microprocessor 24 causes the belt to decelerate in increments of 0.1 mph, by two increments/sec during the first second and by five increments/sec thereafter, until the user is returned to the steady state zone.

An important feature of this invention is a safety off switch. Thus, if the user 12 either moves more than 36 inches away from the control panel 18 (the "stop zone"), or steps off the belt 14, the user is out of range, and the microprocessor 24 turns the belt 14 off altogether as a safety precaution.

The software for the microprocessor can be written so that the steady state, speed up, slow down, and stop zones correspond to distances other than those discusses here, although these distances have been found to be advantageous. Likewise, the software can be written to accommodate other acceleration and deceleration parameters other than the ones discussed herein.

Figure 6:
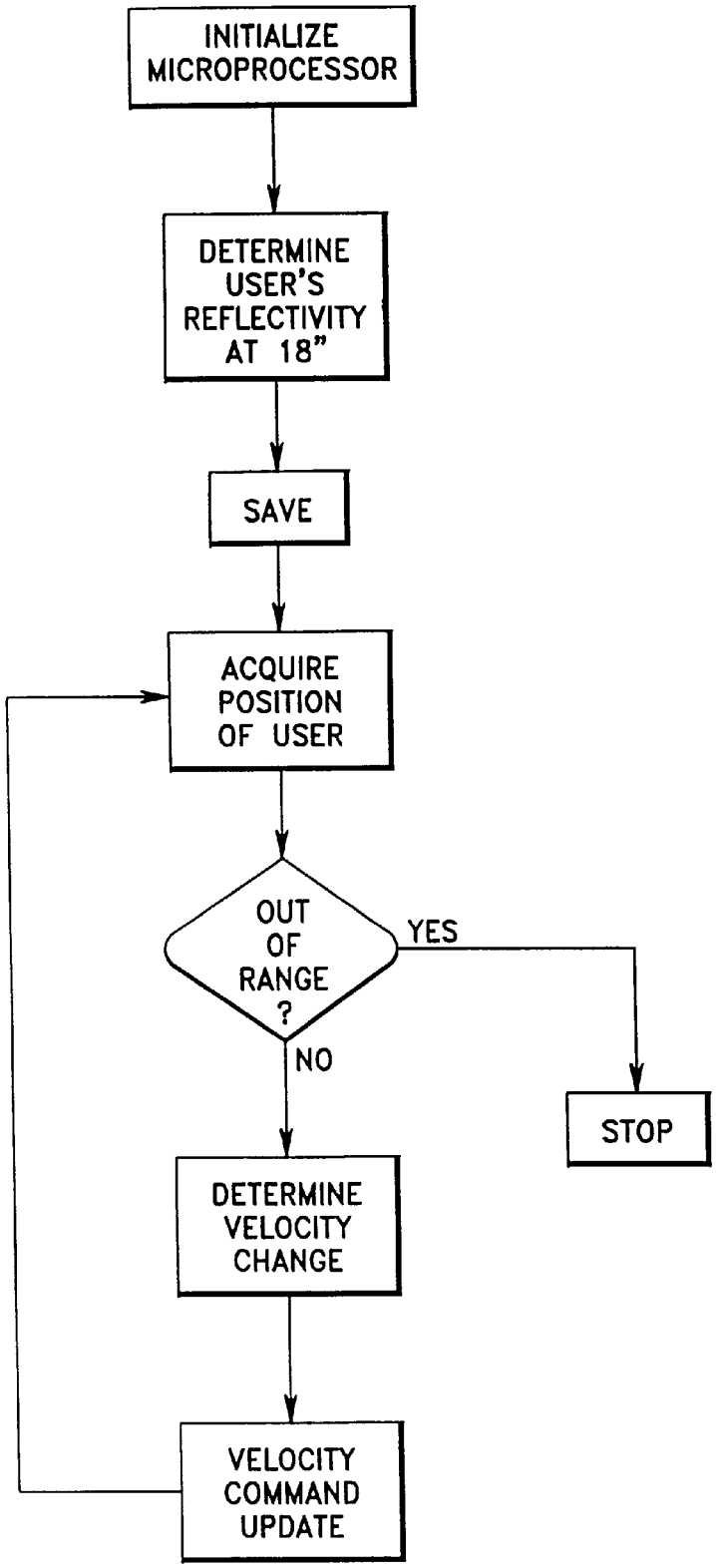
FIG. 6 is a software flow diagram of one embodiment of the invention.

FIG. 6 presents a software flow diagram illustrating the sequence of steps carried out by the microprocessor 24.

Figure 7:
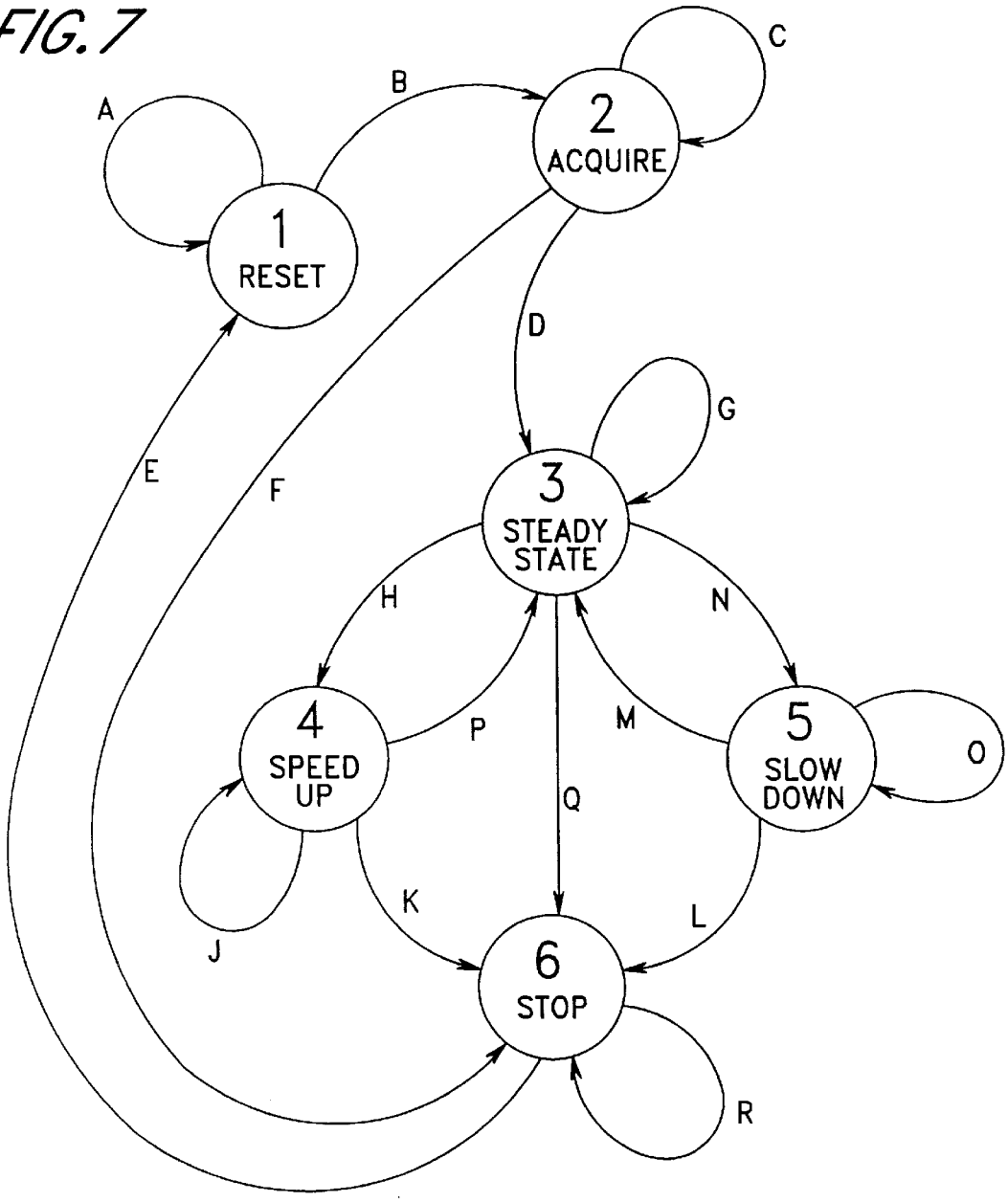
FIG. 7 is a state diagram illustrating the operation of the preferred embodiment of the invention.

After the microprocessor 24 is initialized, the user's reflectivity is determined (cf. FIG. 3) while he stands 18 inches from the control panel 18. This information is saved, so that the microprocessor subsequently recognizes in which zone the user 12 is located. The user's position is then repetitively updated by averaging a series of 5 pulses. After each update, the microprocessor 24 determines where the user 12 is positioned and instructs the belt 14 to slow up, slow down, stop or maintain a constant speed as required to keep up with the walking or running pace of the user. The logic of these steps is shown in alternative fashion by the state diagram of FIG. 7, in which "*" and "/" have their convention meaning, e.g., "/acquire" means not done acquiring, "acquire" means done acquiring, and "*" means logical AND.

We claim:

1. An exercise treadmill machine comprising:

a treadmill in the form of an endless-belt mounted on or within a supporting chassis and having an exposed upper treading surface upon which a user may walk or run;

a motor for driving the treadmill at a desired speed;

an optical sensor mounted in substantial fixed relation with the chassis and adapted to sense the position of a user by measuring the relative intensity of a frequency-modulated signal reflected by the user; and control circuitry for averaging a series of multiple sensed positions to provide a computed average position and periodically increasing and/or decreasing the speed of the motor in accordance with the computed average position of the user so as to maintain the user in a substantially fixed position relative to the chassis.

2. The exercise treadmill machine of claim 1 wherein the optical sensor includes an infrared (IR) emitter and an IR detector.

3. The exercise treadmill machine of claim 2 wherein the emitter directs a beam of electromagnetic radiation toward the torso of the user in a solid angle of approximately 20 degrees, and whereby some of the emitted beam is caused to be reflected off the user and is detected by the detector.

4. The exercise treadmill machine of claim 3 wherein the position of the user is determined by comparing the measured intensity of the reflected radiation to a preestablished reference intensity measured when the user was in a know position.

5. The exercise treadmill machine of claim 3 wherein the emitted radiation is frequency modulated at or near 32.7 kHz.

6. The exercise treadmill machine of claim 1 further comprising a control panel mounted in substantial fixed relation with the chassis and oriented toward the front of the user as said user is walking or running in a forward direction and wherein the optical sensor is disposed within the control panel.

7. The exercise treadmill machine of claim 1 wherein the control circuitry comprises a preprogrammed microprocessor.

8. The exercise treadmill machine of claim 7 wherein the control circuitry further comprises a bandpass filter at about 32.7 kHz.

9. A control system for an exercise treadmill machine of the type having a treadmill in the form of an endless-belt driven by an associated motor, comprising:

an optical sensor adapted to measure the intensity of a frequency-modulated signal reflected by the user;

a comparator to compare the measured intensity of the reflected signal to a predetermined reference intensity measured when the user was in a known position; and control circuitry for averaging a series of multiple measured intensities to determine an average intensity and increasing the speed of the motor when the average intensity is greater than the predetermined intensity and for decreasing the speed of the motor when the average intensity is less than the predetermined intensity so as to maintain the user in a substantially fixed position relative to the optical sensor.

10. The control system of claim 9 wherein the optical sensor includes an infrared (IR) emitter and an IR detector.

11. The control system of claim 10 wherein the emitter directs a beam of electromagnetic radiation toward the torso of the user in a solid angle of approximately 20 degrees, and whereby some of the emitted beam is caused to be reflected off the user and is detected by the detector.

12. The control system of claim 11 wherein the emitted radiation is frequency modulated at or near 32.7 kHz.

13. The control system of claim 9 further comprising a control panel and wherein the optical sensor is disposed within the control panel.

14. The control system of claim 8 wherein the control circuitry comprises a preprogrammed microprocessor.

15. The control system of claim 14 wherein the control circuitry further comprises a bandpass filter at about 32.7 kHz.

16. A method for controlling the position of a user using an exercise treadmill machine of the type having a treadmill in the form of an endless-belt driven by an associated motor, comprising the steps of:

emitting a burst of frequency-modulated radiation directed at the user;

measuring the intensity of radiation reflected by the user at the modulated frequency while the user is in a known position, to establish a reference intensity;

measuring the intensity of radiation reflected by the user at the modulated frequency while the user is exercising on the treadmill;

comparing the measured intensity of the reflected radiation to the reference intensity; and periodically adjusting the speed of the motor when the measured intensity is greater than or less than the predetermined intensity such that the user is maintained in a substantially fixed position.

17. The method of claim 16 wherein the radiation comprises infrared (IR) radiation.

18. The method of claim 16 wherein a beam of radiation is directed toward the torso of the user in a solid angle of approximately 20 degrees whereby a portion of the beam is reflected off the user.

19. The method of claim 16 comprising the further step of modulating the radiation at or near a frequency of 32.7 kHz.

20. The method of claim 16 wherein intensity measurements are taken at about 10 per second and wherein about 5 such measurements are averaged to attain the average intensity.

21. An exercise treadmill machine, comprising:

a treadmill in the form of an endless belt mounted on or within a supporting chassis and having an exposed upper treading surface upon which a user may walk or run;

a motor for driving the treadmill at a desired speed;

an optical sensor mounted in substantial fixed relation to the chassis and generally perpendicular to the direction of motion of the endless belt, the optical sensor being adapted to sense the position of a user by measuring the relative intensity of a frequency-modulated signal reflected by the user; and control circuitry for periodically increasing and/or decreasing the speed of the motor in accordance with the sensed position of the user so as to maintain the user in a substantially fixed position relative to the chassis.

22. A control system for an exercise treadmill machine of the type having a treadmill in the form of an endless-belt driven by an associated motor, comprising:

an optical sensor disposed generally perpendicular to the direction of motion of the endless belt and adapted to measure the intensity of the reflected by the user;

a comparator to compare the measured intensity of the reflected signal to a preestablished reference intensity measured when the user was in a known position; and control circuitry for averaging a series of multiple measured intensities to determine an average intensity and increasing the speed of the motor when the average intensity is greater than the predetermined intensity and for decreasing the speed of the motor when the average intensity is less than the predetermined intensity so as to maintain the user in a substantially fixed position relative to the optical sensor.

23. A method for controlling the position of a user using an exercise treadmill of the type having a treadmill in the form of an endless-belt driven by an associated motor, comprising the steps of:

emitting a burst of radiation directed at the user, the radiation travelling along an axis substantially parallel to the direction of motor of the endless-belt;

measuring the intensity of the radiation reflected by the user;

averaging a series of multiple measured intensities to determine an average intensity;

comparing the average intensity of the reflected radiation to a predetermined reference intensity measured when the user was in a known position; and periodically adjusting the speed of the motor when the average intensity is greater than or less than the predetermined intensity such that the user is maintained in a substantially fixed position.

* * * * *